US012091977B2

(12) United States Patent
Jiang et al.

(10) Patent No.: US 12,091,977 B2
(45) Date of Patent: Sep. 17, 2024

(54) ROADWAY/TUNNEL EXCAVATION ROBOT AND AUTOMATIC CUTTING CONTROL METHOD

(71) Applicant: China University of Mining and Technology, Suzhou (CN)

(72) Inventors: Hongxiang Jiang, Suzhou (CN); Zhencai Zhu, Suzhou (CN); Songyong Liu, Suzhou (CN); Gang Shen, Suzhou (CN); Xiaodi Zhang, Suzhou (CN); Huihe Zhao, Suzhou (CN); Hongsheng Li, Suzhou (CN)

(73) Assignee: China University of Mining and Technology, Jiangsu (CN)

( * ) Notice: Subject to any disclaimer, the term of this patent is extended or adjusted under 35 U.S.C. 154(b) by 0 days.

(21) Appl. No.: 18/031,869

(22) PCT Filed: Sep. 30, 2022

(86) PCT No.: PCT/CN2022/123152
§ 371 (c)(1),
(2) Date: Apr. 13, 2023

(87) PCT Pub. No.: WO2023/221368
PCT Pub. Date: Nov. 23, 2023

(65) Prior Publication Data

US 2024/0141784 A1 May 2, 2024

(30) Foreign Application Priority Data

May 20, 2022 (CN) ..... 202210554910.9

(51) Int. Cl.
*E21D 9/10* (2006.01)
*E21C 31/04* (2006.01)
(Continued)

(52) U.S. Cl.
CPC ..... *E21D 9/102* (2013.01); *E21D 9/1066* (2013.01); *E21D 9/108* (2013.01); *E21C 31/04* (2013.01);
(Continued)

(58) Field of Classification Search
CPC ..... E21C 31/04; E21C 35/24; E21C 35/282; E21C 35/302; E21D 9/111; E21D 9/003;
(Continued)

(56) References Cited

U.S. PATENT DOCUMENTS 6,167,968 B1 1/2001 Allarie et al.
7,182,407 B1 * 2/2007 Peach ..... E21C 25/16 299/75
(Continued)

FOREIGN PATENT DOCUMENTS

CN 108547627 9/2018
CN 110318766 10/2019
CN 114876486 8/2022

OTHER PUBLICATIONS

"International Search Report (Form PCT/ISA/210) of PCT/CN2022/123152", mailed on Jan. 20, 2023, pp. 1-5.
(Continued)

*Primary Examiner* — Christopher J Sebesta
*Assistant Examiner* — Michael A Goodwin
(74) *Attorney, Agent, or Firm* — JCIPRNET

(57) ABSTRACT

A roadway/tunnel excavation robot and an automatic cutting control method are provided. The robot includes a rack, a walking platform, a supporting and stabilizing mechanism, a milling mechanism, a telescoping mechanism, an inclined cutting feed adjusting mechanism, a horizontal swinging mechanism, a lifting mechanism and a controller. The milling mechanism includes a drive unit, a milling shaft, an eccentric rotary casing, a high-pressure jet nozzle unit, a
(Continued)

tension and compression sensor and a direction sensor. Through the deflection of a center line of an inner hole of the eccentric rotary casing, the milling mechanism drives a milling cutter head to carry out a rotational oscillation motion for rock breaking. The telescoping mechanism, the inclined cutting feed adjusting mechanism, the lifting mechanism and the horizontal swinging mechanism are controlled such that the milling mechanism performs coal rocks milling.

10 Claims, 4 Drawing Sheets

(51) Int. Cl.
*E21C 35/24* (2006.01)
*E21D 9/00* (2006.01)

(52) U.S. Cl.
CPC ..... *E21C 35/24* (2013.01); *E21D 9/003* (2013.01); *E21D 9/1093* (2013.01)

(58) Field of Classification Search
CPC ..... E21D 9/102; E21D 9/1046; E21D 9/106; E21D 9/1066; E21D 9/108; E21D 9/1086; E21D 9/1093
See application file for complete search history.

(56) References Cited

U.S. PATENT DOCUMENTS

2002/0093239 A1* 7/2002 Sugden ..... E21D 9/1013 299/71
2011/0181097 A1* 7/2011 Skea ..... E21C 25/16 299/73
2013/0033090 A1* 2/2013 Jokonya ..... E21F 13/06 299/30
2017/0342835 A1* 11/2017 de Sousa ..... E21C 27/20
2018/0023390 A1 1/2018 Moberg et al.
2018/0051562 A1* 2/2018 Daher ..... E21C 31/12
2018/0087380 A1* 3/2018 Lugg ..... E21D 9/1026

OTHER PUBLICATIONS

"Written Opinion of the International Searching Authority (Form PCT/ISA/237) of PCT/CN2022/123152", mailed on Jan. 20, 2023, pp. 1-4.

* cited by examiner

ROADWAY/TUNNEL EXCAVATION ROBOT AND AUTOMATIC CUTTING CONTROL METHOD

CROSS-REFERENCE TO RELATED APPLICATION

This application is a 371 of international application of PCT application serial no. PCT/CN2022/123152, filed on Sep. 30, 2022, which claims the priority benefit of China application no. 202210554910.9, filed on May 20, 2022. The entirety of each of the above mentioned patent applications is hereby incorporated by reference herein and made a part of this specification.

TECHNICAL FIELD

The present invention relates to the field of excavation of coal-rock roadways/tunnels with high protodyakonov coefficient, and particularly relates to a roadway/tunnel excavation robot and an automatic cutting control method.

RELATED ART

Energy industry is the fundamental industry of the national economy, and is also a technology-intensive industry. "Safety, high efficiency and low carbon" intensively embodies the characteristics of modern energy technologies, and is also the main direction to seize the commanding heights of future energy technologies. In order to use unlimited science and technologies to solve the constraints of limited energy and resources, focus on improving the safe and efficient development of energy and resources, promote the transformation of energy production and utilization modes, and plan to take the energy exploration and extraction technology as one of the four key development fields, it is necessary to develop resource-safe, efficient, economical and environmentally friendly mining technologies and equipment under complex geological conditions, for example, to develop a heading machine applicable to rock compressive strength of 100 MPa, and efficient underground power and rock breaking systems, and the like. With the wide application of various types of rock excavation machines in practical projects such as mining, tunnel excavation, and oil and gas well drilling, and the like, higher requirements and new challenges are put forward for hard rock breaking technologies. Mechanical rock breaking has the advantages of large fragmentation and high operating efficiency and the like, and has been widely used in the fields of mining, constructional engineering and resource exploration, and the like. However, when existing equipment is used in the excavation operations of hard rock masses, tool wear is increased, and then the reliability and the work efficiency are reduced, and thus, how to achieve the high-efficiency breaking of hard rocks has become an issue and problem that urgently need to be solved, and it is urgent to study new rock breaking methods to achieve the efficient breaking of hard rocks, which is of great significance to the realization of efficient mining of mines, efficient excavation of tunnels, even the efficient development of energy resources in China.

In the past, the mechanical breaking of hard rocks is achieved mainly by increasing the mechanical driving power, but the rock breaking capacity of mechanical cutting picks is not changed, and only power increasing will result in that the wear of rock breaking mechanisms is intensified and dust on working faces is increased, so that the rock breaking efficiency of machines is difficult to be effectively improved, and the potential safety hazard is increased.

SUMMARY OF INVENTION

Objective of the invention: in order to overcome the deficiencies existing in the prior art, the present invention provides a roadway/tunnel excavation robot and an automatic cutting control method. Through the deflection of a center line of an inner hole of an eccentric rotary casing, a milling mechanism drives a drill and milling hob to carry out a rotational oscillation motion for rock breaking, and the robot is controlled by a controller to realize the automatic cutting of a dish-shaped hob driven by the milling mechanism.

To achieve the above objective, the technical solution adopted by the present invention is as follows:

a roadway/tunnel excavation robot includes:

a rack; a walking platform disposed at the bottom of the rack, and configured for the movement of the rack; a supporting and stabilizing mechanism disposed on the rack and configured to support the top and side parts of rock masses; a milling mechanism configured to mill coal-rock masses; a telescoping mechanism disposed between the milling mechanism and the rack to cause the milling mechanism to extend and retract; a horizontal swinging mechanism disposed between the telescoping mechanism and the rack to cause the milling mechanism to swing leftwards and rightwards; an inclined cutting feed adjusting mechanism disposed between the telescoping mechanism and the milling mechanism to cause the inclined cutting direction of the milling mechanism to be changed; a lifting mechanism disposed between the horizontal swinging mechanism and the rack to cause the milling mechanism to swing up and down; and a controller configured to control the operation of a milling mechanism of the robot; wherein the milling mechanism includes: a drive unit, having a drive end that is in driving connection with the eccentric rotary casing, and fixedly connected to a milling mechanism housing; a milling shaft, provided with a milling cutter head at a milling end thereof, and provided with a limiting member at a middle section thereof, the limiting member being configured to counteract an axial force acting on a rotational body; an eccentric rotary casing, disposed between the milling shaft and the drive unit, and internally provided with an inner hole, where the inner hole is in mating connection with the milling shaft, and an included angle exists between an axis, i.e., a center line I, of the inner hole and an axis, i.e., a center line II of the eccentric rotary casing, such that the milling cutter head on the milling shaft performs rotational oscillation for milling and rock breaking; a high-pressure jet nozzle unit, disposed on the milling end to form a high-pressure jet to assist the milling cutter head in breaking rocks; a tension and compression sensor, disposed on the milling mechanism housing, in signal connection with the controller, and configured to detect a force load of a connecting fastener in the milling mechanism; and a direction sensor, disposed on the milling mechanism housing, in signal connection with the controller, and configured to detect a movement direction of the milling cutter head.

As a preferred embodiment of the present invention: the eccentric rotary casing includes: a casing, provided with an inner hole at one end, and having a casing closed end at the other end, where a casing outer-wall is in mating connection with the milling mechanism housing, and the casing closed end is in mating connection with the drive unit; and an eccentric disc disposed on the outer wall of the casing in the middle part, with an eccentric distance between an axis of the eccentric disc and an axis of the eccentric casing; and the inner hole being provided with an enhanced treatment surface.

As a preferred embodiment of the present invention: the milling shaft is divided into the milling end, a spherical section and a connecting section in sequence, the milling end of the milling shaft is connected to the milling cutter head, the limiting member is the spherical section connected to a rear end of the milling end, and a high-pressure sealing ring is disposed at the contact surface of the spherical section and a milling shaft support seat; and the connecting section is mounted in a mating manner to the inner hole of the eccentric rotary casing.

As a preferred embodiment of the present invention: the milling shaft is further provided with: a cooling water inlet channel, connected to a low-pressure water inlet on the milling shaft support seat; a cooling water branch channel, disposed at the contact surface of the inner hole of the eccentric rotary casing and a right-side section of the milling shaft; and a cooling water outlet channel, disposed inside the milling shaft, communicated with the cooling water branch channel, and connected to the milling cutter head.

As a preferred embodiment of the present invention: the high-pressure jet nozzle unit includes a high-pressure water pipe, provided with a high-pressure water opening and closing device in a series connection manner, and connected to a high-pressure water inlet on the milling shaft support seat; the high-pressure water opening and closing device, configured to control the closing of the high-pressure water pipe; and a high-pressure jet nozzle, communicated with the high-pressure water inlet of the milling shaft support seat. As a preferred embodiment of the present invention: the drive unit is an electric motor, the electric motor is secured on the milling mechanism housing by means of screws II, and the milling cutter head is a dish-shaped hob inlaid with a cemented carbide.

As a preferred embodiment of the present invention: the included angle between the center line and the center line II is less than 3 DEG.

As a preferred embodiment of the present invention: the milling mechanism is connected to the inclined cutting feed adjusting mechanism through a hinge hole in an adjusting support member.

As a preferred embodiment of the present invention: the telescoping mechanism includes a square shell, a square extension beam and a telescopic oil cylinder, where a cylinder barrel of the telescopic oil cylinder is fixedly connected to the square shell, a cylinder pole of the telescopic oil cylinder is fixedly connected to the square extension beam, and a displacement sensor is disposed on the telescopic oil cylinder and configured to detect the displacement of the telescopic oil cylinder; the lifting mechanism includes a lifting oil cylinder, one end of the lifting mechanism is connected to a lower hinge hole of the horizontal swinging mechanism, the other end of the lifting mechanism is connected to a middle hinge hole of the square shell, and a lifting angle sensor is disposed at a joint, such that the milling cutter head in the milling mechanism can move up and down in a roadway; and one end of the inclined cutting feed adjusting mechanism is connected to rear-end symmetrical hinge holes of the milling mechanism, the other end of the inclined cutting feed adjusting mechanism is connected to front-end symmetrical hinge holes of the square extension beam, and a milling mechanism angle sensor is disposed in the inclined cutting feed adjusting mechanism to adjust the milling cutter head to reach an inclined cutting state.

An automatic cutting control method of the roadway/tunnel excavation robot includes following steps:

step 1, a walking platform is controlled by a controller to enable a milling mechanism of an excavation robot to fit on a coal-rock mass excavation surface and a supporting and stabilizing mechanism is controlled by the controller to support on roof and floor or sidewall of a roadway; and an anti-skid mechanism is opened and supported on the floor of the roadway;

step 2, a drive unit is driven, an eccentric rotary casing is driven by the drive unit to rotate, and a milling shaft and a milling cutter head are driven to rotationally swing together through the rotation of an inner hole of the eccentric rotary casing; when the drive unit is started, a low-pressure cooling water pipe is opened, and cooling a contact surface of a connecting section of the milling shaft and the inner hole of the eccentric rotary casing are cooled by cooling water flowing through the outer wall of the connecting section of the milling shaft; and when the drive unit is started, a high-pressure water pipe jet unit is started, and a rotationally oscillated cutter head is impacted by a high-pressure jet to form an oscillating jet for assisting the milling cutter head in breaking rocks;

step 3, an inclined cutting feed adjusting mechanism is controlled by the controller to enable a dish-shaped hob to reach an inclined cutting state, a lifting oil cylinder is controlled by the controller to enable the dish-shaped hob to move downwards, and a telescopic oil cylinder is controlled by the controller to enable a square extension beam to extend out of a square shell, so that the dish-shaped hob achieves a downward and forward compound motion to be inclinedly cut into the rock mass; a force load of a connecting fastener between a milling shaft support seat and a milling mechanism housing are indirectly detected by a tension and compression sensor, and when the detected load reaches a preset value, a high-pressure water system is started; a movement direction of the dish-shaped hob is detected by a direction sensor disposed on the milling mechanism housing, and a corresponding high-pressure jet nozzle disposed on the milling shaft support seat is opened by a high-pressure water opening and closing device according to the detected movement direction of the dish-shaped hob, so that an oscillating jet is formed in the movement direction of the dish-shaped hob to assist in rock breaking; and a displacement sensor is disposed on the telescopic oil cylinder to detect the displacement of the telescopic oil cylinder, the telescopic oil cylinder is controlled to enable the dish-shaped hob to reach a predetermined milling thickness, and the inclined cutting feed adjusting mechanism is controlled to enable the dish-shaped hob to approximately fit on the rock mass excavation surface to reach a milling state;

step 4, according to signals of a lifting angle sensor disposed at a hinged position at the tail end of the square shell and a rotary angle sensor at an outer circumferential position of a horizontal swinging mechanism, a position of the dish-shaped hob on the rock mass excavation surface is calculated by the controller, and the lifting oil cylinder and the horizontal swinging mechanism are controlled to enable the dish-shaped hob disposed on the milling mechanism to mill the coal-rock mass according to a preset milling path; and after the milling of the coal-rock mass excavation surface with a predetermined thickness is completed once, the milling mechanism is returned to an initial position in step 1;

step 5, step 3 and step 4 are continuously repeated until the telescopic oil cylinder reaches the maximum stroke, and the supporting and stabilizing mechanism and the anti-skid mechanism are drawn back to complete the milling of coal-rocks after the excavation robot is fixed once;

step 6, steps 1 to 5 are repeated to achieve the automatic cutting of the excavation surface of the coal-rock mass.

Compared with the prior art, the present invention has the following beneficial technical effects:

1. Through the deflection of the center line of the inner hole of the eccentric rotary casing arranged in the robot, the milling mechanism drives the milling cutter head to carry out a rotational oscillation motion, and the milling cutter head is in non-continuous contact with a rock mass, so that the milling cutter head is short in contact path, small in wear and low in temperature, thereby avoiding excessive wear of the cutter head and achieving efficient milling of the rock mass. The milling cutter head is driven to carry out rotational oscillation for rock breaking with a low resistance, axial and radial excitation forces are generated simultaneously, and the non-tensile characteristics of coal rocks are fully utilized, so that the rock breaking efficiency is high.
2. When the milling cutter head mills rocks, a high-pressure jet impacts the rotationally oscillated cutter head to form an oscillating jet for assisting the milling cutter head in breaking rock, which can reduce the difficulty of milling; and after a rock is pre-slitted by the oscillating jet, the rotationally oscillated cutter head is facilitated to mill and break the rock, which makes full use of compression resistance and non-tensile characteristics of the rock, greatly reduces the difficulty of rock breaking, and improves the breaking efficiency of hard rock masses.
3. Through the design of the cooling water channel in the milling shaft, when a rotational oscillation motion is performed in the milling shaft and the inner hole of the eccentric rotary casing, because heat generated by mutual friction is cooled by cooling water, the excessive wear of the milling shaft and the eccentric rotary casing caused by overheating is reduced; and through the setting of the high-pressure sealing ring in the milling shaft and the milling shaft support seat, the leakage of the cooling water is prevented.
4. The controller adjusts the inclined cutting feed adjusting mechanism, the square extension beam, the lifting oil cylinder and the horizontal swinging mechanism according to the displacement sensor, the milling mechanism angle sensor, the lifting angle sensor, the rotary angle sensor, the direction sensor and the tension and compression sensor to achieve the automatic cutting of the dish-shaped hob driven by the milling mechanism, thus, the work efficiency is high, and the forming quality of cutting is good.

Figure 1:
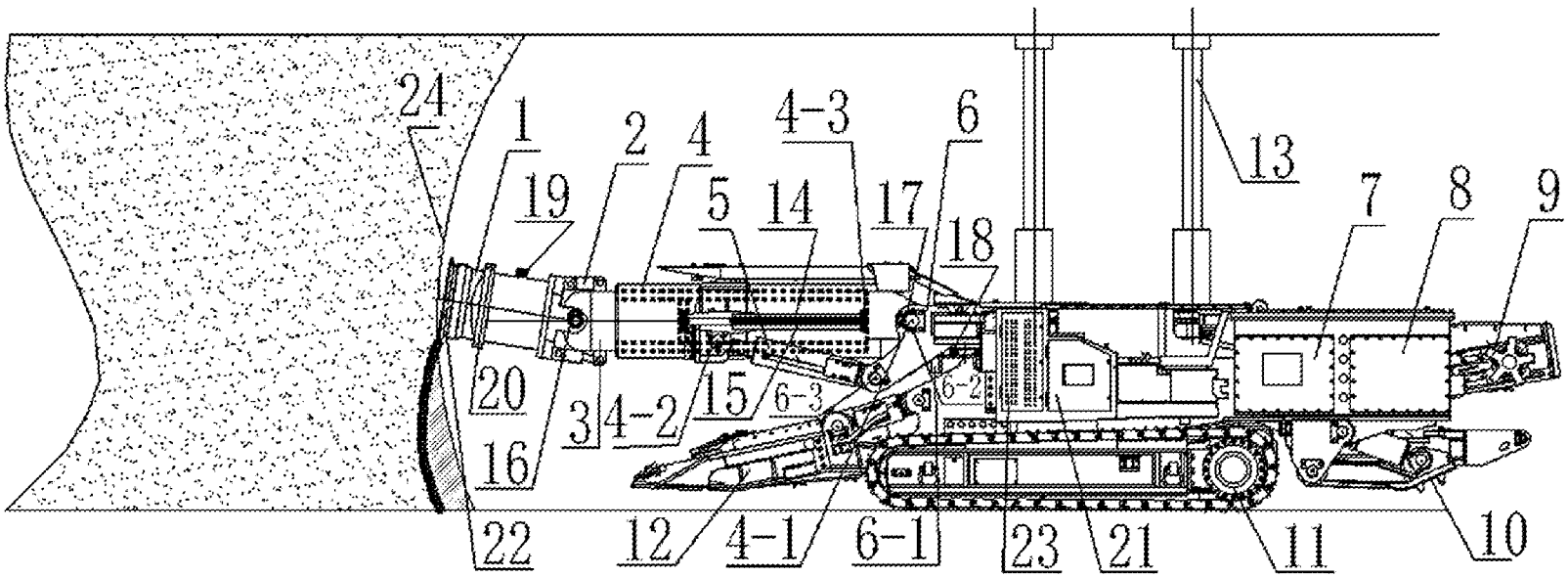
FIG. 1 is an overall view of a roadway/tunnel excavation robot according to the present invention.

In the figures, 1 reference to milling mechanism; 2 reference to inclined cutting feed adjusting mechanism; 3 reference to square extension beam; 4 reference to square shell; 5 reference to lifting oil cylinder; 6 reference to horizontal swinging mechanism; 7 reference to hydraulic power supply; 8 reference to electrical system; 9 reference to rock ballast conveying mechanism; 10 reference to anti-skid mechanism; 11 reference to walking platform; 12 reference to rock ballast collecting mechanism; 13 reference to supporting and stabilizing mechanism; 14 reference to telescopic oil cylinder; 15 reference to displacement sensor; 16 reference to milling mechanism angle sensor; 17 reference to lifting angle sensor; 18 reference to rotary angle sensor; 19 reference to direction sensor; 20 reference to tension and compression sensor; 21 reference to high-pressure water system; 22 reference to high-pressure jet nozzle; 23 reference to controller; 24 reference to coal-rock mass excavation surface; 25 reference to inclined cutting state; 26 reference to milling state; 27 reference to milling path; 1-1 reference to dish-shaped hob; 1-2 reference to screw I; 1-3 reference to milling shaft; 1-4 reference to milling shaft support seat; 1-5 reference to bolt I; 1-6 reference to low-pressure cooling water pipe; 1-7 reference to high-pressure water pipe; 1-8 reference to high-pressure water opening and closing device; 1-9 reference to milling mechanism housing; 1-10 reference to support bearing; 1-12 reference to eccentric rotary casing; 1-13 reference to screw II; 1-14 reference to electric motor; 1-15 reference to screw III; 1-16 reference to adjusting support member; 1-17 reference to rear-end main hinge hole; 1-18 reference to rear-end symmetrical hinge hole; 1-19 reference to high-pressure sealing ring; 1-2-1 reference to inlaid cemented carbide; 1-3-1 reference to milling end; 1-3-2 reference to spherical section; 1-3-3 reference to connecting section; 1-3-4 reference to cooling water inlet channel; 1-3-5 reference to cooling water branch channel; 1-3-6 reference to cooling water outlet channel; 1-4-1 reference to low-pressure water inlet; 1-4-2 reference to high-pressure water inlet; 1-12-1 reference to inner hole; 1-12-2 reference to casing outer-wall; 1-12-3 reference to casing closed end; 1-12-4 reference to eccentric disc; 1-12-5 reference to center line I; 1-12-6 reference to center line II; 3-1 reference to middle support seat; 3-2 reference to front-end main hinge hole; 3-3 reference to front-end symmetrical hinge hole; 3-4 reference to four surfaces; 4-1 reference to right hinge hole; 4-2 reference to middle hinge hole, 4-3 reference to tail support seat; 6-1 reference to rotary end; 6-2 reference to upper hinge hole; and 6-3 reference to lower hinge hole

DESCRIPTION OF EMBODIMENTS

The present disclosure will be further illustrated below with reference to the accompanying drawings and specific embodiments. It should be understood that these examples are merely used to illustrate the present invention and are not intended to limit the scope of the present invention. All modifications in various equivalent forms made to the present invention by those skilled in the art after reading the present invention, fall within the scope defined by the appended claims of the present application.

As shown in FIGS. 1-6, this embodiment provides a roadway/tunnel excavation robot, in which a milling mechanism is configured to complete automatic inclined cutting feed and milling of coal-rock masses; through the deflection of a center line of an inner hole of an eccentric rotary casing arranged in the robot, the milling mechanism drives a milling cutter head to carry out a rotational oscillation motion, and the milling cutter head is in non-continuous contact with a rock mass, so that the milling cutter head is short in contact path, small in wear and low in temperature, thereby avoiding excessive wear of the cutter head and achieving efficient milling of the rock mass. The milling cutter head is driven to carry out rotational oscillation for rock breaking with a low resistance, axial and radial excitation forces are generated simultaneously, and the non-tensile characteristics of coal rocks are fully utilized, so that the rock breaking efficiency is high. In operation, a high-pressure jet impacts the rotationally oscillated cutter head to form an oscillating jet for assisting the milling cutter head in breaking rocks, which can reduce the difficulty of milling; and after a rock is pre-slitted by the oscillating jet, the rotationally oscillated cutter head is facilitated to break the rock, which greatly reduces the difficulty of rock breaking, and improves the breaking efficiency of hard rock masses.

The roadway/tunnel excavation robot includes a controller 23, and a milling mechanism 1, an inclined cutting feed adjusting mechanism 2, a square extension beam 3, a square shell 4, a lifting oil cylinder 5, a horizontal swinging mechanism 6, a hydraulic power supply 7, an electrical system 8, a rock ballast conveying mechanism 9, an anti-skid mechanism 10, a walking platform 11, a rock ballast collecting mechanism 12, a supporting and stabilizing mechanism 13, a telescopic oil cylinder 14, a displacement sensor 15, a milling mechanism angle sensor 16, a lifting angle sensor 17, a rotary angle sensor 18, a direction sensor 19, a tension and compression sensor 20, a high-pressure water system 21 and a high-pressure jet nozzle 22, that are in signal connection with the controller 23, where the hydraulic power supply 7, the electrical system 8, the rock ballast conveying mechanism 9, the anti-skid mechanism 10, the rock ballast collecting mechanism 12, the supporting and stabilizing mechanism 13, and the high-pressure water system 21 and the like are all disposed on the walking platform 11 to form a rack of the whole roadway/tunnel excavation robot.

Figure 2:
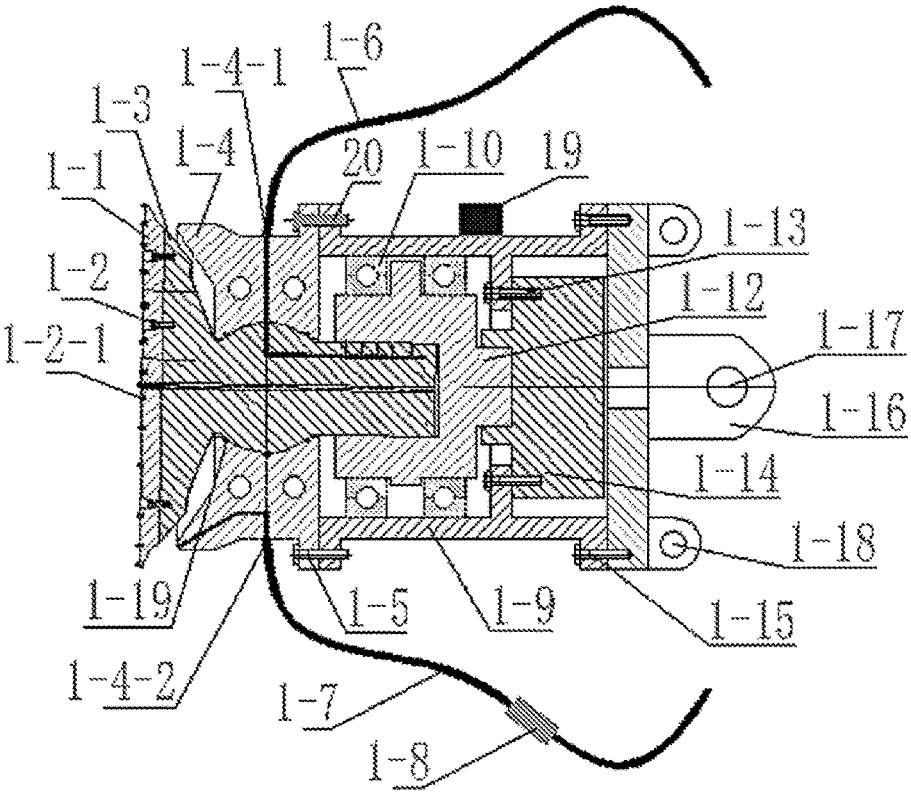
FIG. 2 is a sectional view of a milling mechanism in the present invention.

As shown in FIG. 2, the milling mechanism includes: a drive unit, a milling shaft 1-3, an eccentric rotary casing 1-12, a support bearing 1-10, an adjusting support member 1-16, and a high-pressure jet nozzle unit, where, a drive end of the drive unit is in driving connection with the eccentric rotary casing, the drive unit is an electric motor 1-14, and the electric motor is secured on a milling mechanism housing 1-9 by means of screws II 1-13.

Figure 3:
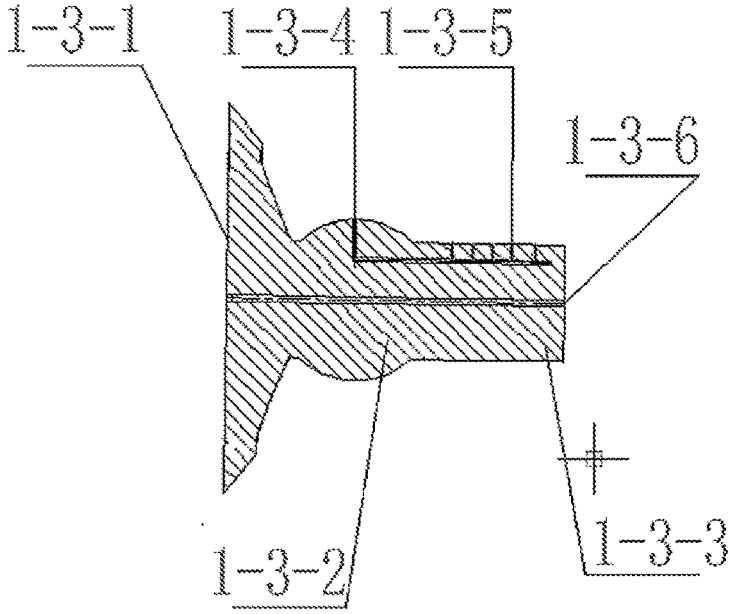
FIG. 3 is a sectional view of a milling shaft in the present invention.

As shown in FIG. 3, the milling shaft 1-3 includes: a milling end 1-3-1 which is an end of the milling shaft 1-3 that is connected to a milling cutter head; a milling shaft support seat 1-4 which is connected to the milling mechanism housing 1-9 through bolts I 1-5; a spherical section 1-3-2 which is a limiting member in the milling shaft, and disposed between a left half and a right half of the milling shaft support seat 1-4, where a high-pressure sealing ring 1-19 is disposed at the contact surface of the spherical section and the milling shaft support seat 1-4, and through the setting of the high-pressure sealing rings 1-19, the leakage of cooling water is prevented; a connecting section 1-3-3 which is an end that is mounted in a mating manner to the inner hole 1-12-1 of the eccentric rotary casing. The milling shaft is further internally provided with: a cooling water inlet channel, 1-3-4 connected to a low-pressure water inlet 1-4-1 on the milling shaft support seat 1-4; a cooling water branch channel 1-3-5 disposed at the contact surface of the inner hole 1-12-1 of the eccentric rotary casing 1-12 and a right-side section 1-3-3 of the milling shaft 1-3; and a cooling water outlet channel 1-3-6 disposed inside the milling shaft, communicated with the cooling water branch channel, and connected to the milling cutter head; and a dish-shaped hob 1-1 inlaid with a cemented carbide 1-2-1 is secured on a left end face 1-3-1 of the milling shaft 1-3 through screws I 1-2.

Figure 4:
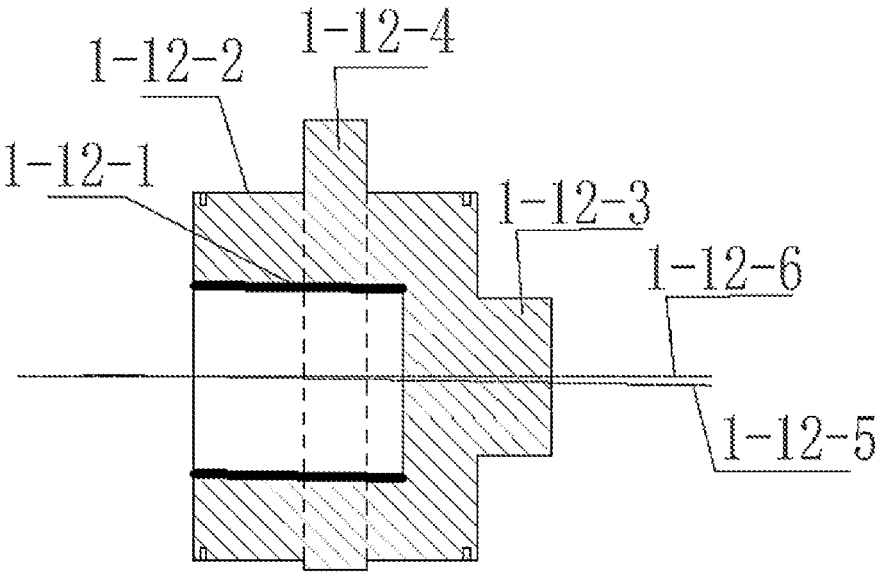
FIG. 4 is a sectional view of an eccentric rotary casing in the present invention.

As shown in FIG. 4, the eccentric rotary casing 1-12 includes: a casing, provided with an inner hole 1-12-1 at one end, and having a casing closed end at the other end, where a casing outer-wall is in mating connection with the milling mechanism housing, and the casing closed end 1-12-3 is in mating connection with the electric motor; an eccentric disc disposed on the outer wall of the casing in the middle part, with an eccentric distance between an axis of the eccentric disc and an axis of the eccentric casing; and an inner hole which is provided with an enhanced treatment surface, where there is an included angle between a center line I 1-12-5 of the inner hole 1-12-1 and a center line II 1-12-6 of the outer surface 1-12-2, and the included angle is generally less than 3 DEG. A right end 1-12-3 of the eccentric rotary casing 1-12 is connected to the electric motor 1-14 by means of a key.

The inner and outer rings of the support bearing 1-10 are respectively in mating connection with the outer surface 1-12-2 of the eccentric rotary casing 1-12 and the inner hole of the milling mechanism housing 1-9.

The adjusting support member 1-16 is provided with a rear-end main hinge hole 1-17 and rear-end symmetrical hinge holes 1-18 connected to the milling mechanism housing 1-9 through screws III 1-15.

The high-pressure jet nozzle unit is connected to the high-pressure water system 21 and includes: a high-pressure water pipe 1-7, provided with a high-pressure water opening and closing device 1-8 in a series connection manner, and connected to a high-pressure water inlet 1-4-2 on the milling shaft support seat 1-4; the high-pressure water opening and closing device 1-8, configured to control the closing of the high-pressure water pipe; and a high-pressure jet nozzle, communicated with the high-pressure water inlet 1-4-2 of the milling shaft support seat 1-4. A high-pressure water jet impacts the rotationally oscillated cutter head to form an oscillating jet.

The walking platform 11 is disposed at the bottom of the rack and configured for the movement of the rack; and the supporting and stabilizing mechanism 13 is disposed on the rack and configured to support the top and side parts of rock masses.

The tension and compression sensor 20 is disposed between the milling shaft support base 1-4 and the milling mechanism housing 1-9, and the direction sensor 19 is disposed on the surface of the milling mechanism housing 1-9.

Figure 5:
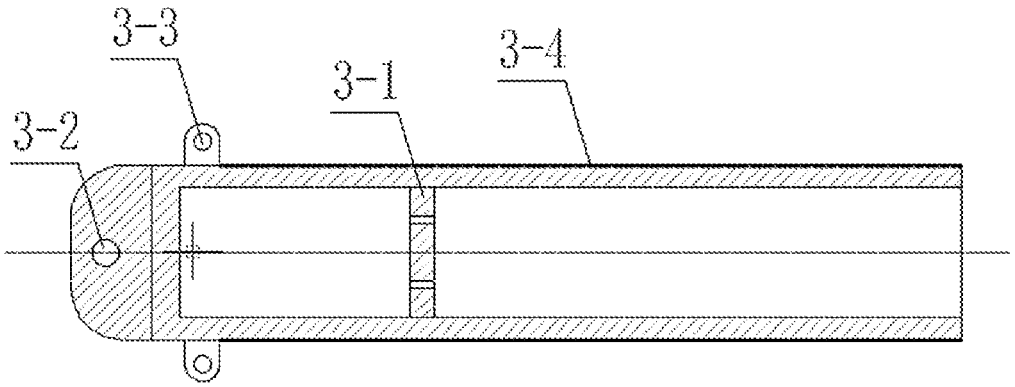
FIG. 5 is a sectional view of a square extension beam in the present invention.
Figure 6:
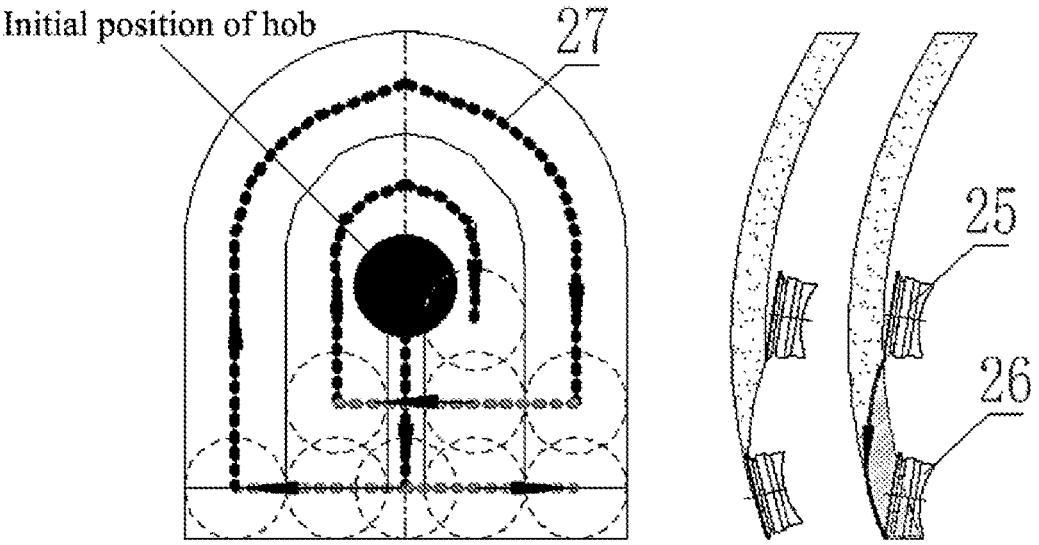
FIG. 6 is a schematic diagram of an inclined cutting mode and a milling path of a dish-shaped hob in the present invention.

The telescoping mechanism includes: a square shell 4, a square extension beam 3 and a telescopic oil cylinder 14, where the telescopic oil cylinder 14 is respectively connected to a tail support seat 4-3 of the square shell 4 and a middle support seat 3-1 of the square extension beam 3, a cylinder barrel of the telescopic oil cylinder 14 is fixedly connected to the square shell 4, a cylinder pole of the telescopic oil cylinder 14 is fixedly connected to the square extension beam 3, the displacement of the telescopic oil cylinder 14 detected by the displacement sensor 15 is controlled, and the controller controls the square extension beam to move relative to the square shell. As shown in FIG. 5, the middle support seat 3-1 of the square extension beam is connected to a piston rod of the telescopic oil cylinder 14, a front-end main hinge hole 3-2 is hinged with a rear-end main hinge hole 1-17 of the milling mechanism 1, front-end symmetrical hinge holes 3-3 are connected to rear-end symmetrical hinge holes 1-18 of the milling mechanism 1 through the inclined cutting feed adjusting mechanism 2, and four surfaces 3-4 of the square extension beam 3 are subjected to enhancement treatment.

The horizontal swinging mechanism 6 is disposed between the rack and the square shell through an upper hinge hole 6-2, and a rotary end 6-1 is vertically rotarily disposed on the front side of the walking platform 11, and the rotary angle sensor 18 is disposed between the rack and the horizontal swinging mechanism to cause the square shell 4 to swing leftwards and rightwards.

The lifting mechanism includes a lifting oil cylinder, and is respectively connected to a lower hinge hole 6-3 of the horizontal swinging mechanism 6 and a middle hinge hole 4-2 of the square shell 4, and the lifting angle sensor 17 is disposed at the joint of a right hinge hole 4-2 of the square shell 4 and the upper hinge hole 6-2 of the horizontal swinging mechanism 6, such that the milling cutter head in the milling mechanism can move up and down in a roadway.

The two ends of the inclined cutting feed adjusting mechanism are respectively connected to the rear-end symmetrical hinge holes 1-18 of the milling mechanism 1 and the front-end symmetrical hinge holes 3-3 of the square extension beam 3; and the inclined cutting feed adjusting mechanism allows the rear-end main hinge hole 1-17 of the milling mechanism 1 to hinge with the front-end main hinge hole 3-2 of the square extension beam 3, and is provided with a milling mechanism angle sensor 16. The inclined cutting feed adjusting mechanism is configured to adjust the milling cutter head to reach an inclined cutting state.

According to the displacement sensor 15, the milling mechanism angle sensor 16, the lifting angle sensor 17, the rotary angle sensor 18, the tension and compression sensor 20 and the direction sensor 19, the controller controls the inclined cutting feed adjusting mechanism 2, the lifting oil cylinder 14, the horizontal swinging mechanism 6, the telescopic oil cylinder 5, and an opening and closing device of the oscillating jet nozzle 22, and the like, such that the milling mechanism 1 automatically performs inclined cutting feed and milling of coal-rock masses under the assistance of a directional water jet.

An automatic cutting control method of a roadway/tunnel excavation robot, which is based on the roadway/tunnel excavation robot and includes the following steps:

step 1, a walking platform 11 is controlled by a controller to enable a milling mechanism 1 of the excavation robot to fit on a coal-rock mass excavation surface 24 and a supporting and stabilizing mechanism 13 is controlled by the controller to support on the roof and floor or sidewall of a roadway; and an anti-skid mechanism and is opened and supported on the floor of the roadway.

step 2, a drive unit is started, an eccentric rotary casing is driven by the drive unit to rotate, and a milling shaft and a milling cutter head are driven to rotationally swing together through the rotation of an inner hole of the eccentric rotary casing; when the drive unit is started, a low-pressure cooling water pipe is opened, and the contact surface of a connecting section of the milling shaft and the inner hole of the eccentric rotary casing are cooled by cooling water flowing through the outer wall of the connecting section of the milling shaft; and when the drive unit is started, a high-pressure water pipe jet unit is started, and a rotationally oscillated cutter head is impacted by a high-pressure jet to form an oscillating jet for assisting the milling cutter head in breaking rocks.

step 3, an inclined cutting feed adjusting mechanism 2 is controlled by the controller to enable a dish-shaped hob 1-1 to reach an inclined cutting state 25, a lifting oil cylinder 5 is controlled by the controller to enable the dish-shaped hob 1-1 to move downwards, and a telescopic oil cylinder 14 is controlled by the controller to enable a square extension beam 3 to extend out of a square shell 4, so that the dish-shaped hob 1-1 achieves a downward and forward compound motion to be inclinedly cut into the rock mass; a force load of a connecting fastener between a milling shaft support seat 1-4 and a milling mechanism housing 1-9 are indirectly detected by a tension and compression sensor 20, and when the detected load reaches a preset value, a high-pressure water system 21 disposed on a walking platform 11 is started; a movement direction of the dish-shaped hob 1-1 is detected by a direction sensor 19 disposed on the milling mechanism housing 1-9, and a corresponding high-pressure jet nozzle 22 disposed on the milling shaft support seat 1-4 is opened by a high-pressure water opening and closing device 1-8 according to the detected movement direction of the dish-shaped hob 1-1, so that an oscillating jet is formed in the movement direction of the dish-shaped hob 1-1 to assist in rock breaking; and a displacement sensor 15 is disposed on the telescopic oil cylinder 14 to detect the displacement of the telescopic oil cylinder, the telescopic oil cylinder 14 is controlled to enable the dish-shaped hob 1-1 to reach a predetermined milling thickness, and the inclined cutting feed adjusting mechanism 2 is controlled to enable the dish-shaped hob 1-1 to approximately fit on the rock mass excavation surface 24 to reach a milling state 26.

step 4, according to signals of a lifting angle sensor 17 disposed at a hinged position at the tail end of the square shell 4 and a rotary angle sensor 18 at an outer circumferential position of a horizontal swinging mechanism 6, a position of the dish-shaped hob 1-1 on the rock mass excavation surface 24 is calculated by the controller 23, and the lifting oil cylinder 5 and the horizontal swinging mechanism 6 are controlled to enable the dish-shaped hob 1-1 disposed on the milling mechanism 1 to mill the coal-rock mass according to a preset milling path 27; and after the milling of the coal-rock mass excavation surface 24 with a predetermined thickness is completed once, the milling mechanism 1 is returned to an initial position in step 1.

step 5, step 3 and step 4 are continuously repeated until the telescopic oil cylinder 14 reaches the maximum stroke, and the supporting and stabilizing mechanism 13 and the anti-skid mechanism 10 are drawn back to complete the milling of coal-rocks after the excavation robot is fixed once.

step 6, steps 1 to 5 are repeated to achieve the automatic cutting of the coal-rock mass excavation surface 24.

The above are only the preferred embodiments of the present invention. It should be noted that several improvements and modifications can be made for those skilled in the art without departing from the principles of the present invention, and these improvements and modifications should also be considered as falling within the protection scope of the present invention.

What is claimed is:

1. A roadway/tunnel excavation robot, comprising:

a rack;

a walking platform, disposed at a bottom of the rack, and configured to move the rack;

a supporting and stabilizing mechanism, disposed on the rack, and configured to support a roof and floor or sidewall of a roadway;

a milling mechanism, configured to mill coal-rock masses;

a telescoping mechanism, disposed between the milling mechanism and the rack to cause the milling mechanism to extend and retract;

a horizontal swinging mechanism, disposed between the telescoping mechanism and the rack to cause the milling mechanism to swing leftwards and rightwards;

an inclined cutting feed adjusting mechanism, disposed between the telescoping mechanism and the milling mechanism to cause an inclined cutting direction of the milling mechanism to be changed;

a lifting mechanism, disposed between the horizontal swinging mechanism and the telescoping mechanism to swing up and down;

a controller, configured to control a milling mechanism of the robot;

wherein, the milling mechanism comprises:

a drive unit, having a drive end that is in driving connection with an eccentric rotary casing, and fixedly connected to a milling mechanism housing;

a milling shaft, provided with a milling cutter head at a milling end thereof, and provided with a limiting member at a middle section thereof, the limiting member being configured to counteract an axial force acting on the milling shaft;

the eccentric rotary casing, disposed between the milling shaft and the drive unit, and internally provided with an inner hole, where the inner hole is in mating connection with the milling shaft, and an included angle exists between a first center line, of the inner hole and a second center line, of the eccentric rotary casing, such that the milling cutter head on the milling shaft performs rotational oscillation for milling and rock breaking;

a high-pressure jet nozzle unit, disposed on a milling end of the milling shaft in the milling mechanism to form a high-pressure jet to assist the milling cutter head in breaking rocks;

a tension and compression sensor, disposed on the milling mechanism housing, in signal connection with the controller, and configured to detect a force load of a connecting fastener in the milling mechanism; and a direction sensor, disposed on the milling mechanism housing, in signal connection with the controller, and configured to detect a movement direction of the milling cutter head.

2. The roadway/tunnel excavation robot according to claim 1, wherein, the eccentric rotary casing comprises:

a casing, provided with the inner hole at one end and having a casing closed end at another end, where a casing outer-wall is in mating connection with the milling mechanism housing, and the casing closed end is in mating connection with the drive unit; and an eccentric disc, disposed on an outer wall of the casing in a middle part, with an eccentric distance between an axis of the eccentric disc and an axis of the eccentric casing; and the inner hole being provided with an enhanced treatment surface.

3. The roadway/tunnel excavation robot according to claim 2, wherein, the milling shaft is divided into the milling end, a spherical section and a connecting section in sequence, the milling end of the milling shaft is connected to the milling cutter head, the limiting member is the spherical section connected to a rear end of the milling end, a high-pressure sealing ring is disposed at a contact surface of the spherical section and a milling shaft support seat; and the connecting section is mounted in a mating manner to the inner hole of the eccentric rotary casing.

4. The roadway/tunnel excavation robot according to claim 3, wherein, the milling shaft is further provided with:

a cooling water inlet channel, connected to a low-pressure water inlet on the milling shaft support seat;

a cooling water branch channel, disposed at a contact surface of the inner hole of the eccentric rotary casing and a right-side section of the milling shaft; and a cooling water outlet channel, disposed inside the milling shaft, communicated with the cooling water branch channel, and connected to the milling cutter head.

5. The roadway/tunnel excavation robot according to claim 4, wherein, the drive unit is an electric motor, the electric motor is secured on the milling mechanism housing by means of second screws, and the milling cutter head is a dish-shaped hob inlaid with a cemented carbide.

6. The roadway/tunnel excavation robot according to claim 3, wherein, the high-pressure jet nozzle unit comprises:

a high-pressure water pipe, provided with a high-pressure water opening and closing device in a series connection manner, and connected to a high-pressure water inlet on the milling shaft support seat;

the high-pressure water opening and closing device, configured to control the closing of the high-pressure water pipe; and a high-pressure jet nozzle, communicated with the high-pressure water inlet of the milling shaft support seat.

7. The roadway/tunnel excavation robot according to claim 1, wherein, the included angle between the first center line and the second center line is less than 3 DEG.

8. The roadway/tunnel excavation robot according to claim 1, wherein, the milling mechanism is connected to the inclined cutting feed adjusting mechanism through a hinge hole in an adjusting support member.

9. The roadway/tunnel excavation robot according to claim 8, wherein, the telescoping mechanism comprises a square shell, a square extension beam and a telescopic oil cylinder, where a cylinder barrel of the telescopic oil cylinder is fixedly connected to the square shell, a cylinder pole of the telescopic oil cylinder is fixedly connected to the square extension beam, and a displacement sensor is disposed on the telescopic oil cylinder and configured to detect a displacement of the telescopic oil cylinder;

the lifting mechanism comprises a lifting oil cylinder, one end of the lifting mechanism is connected to a lower hinge hole of the horizontal swinging mechanism, another end of the lifting mechanism is connected to a middle hinge hole of the square shell, and a lifting angle sensor is disposed at a joint, such that the milling cutter head in the milling mechanism can move up and down in a roadway; and the inclined cutting feed adjusting mechanism, one end of the inclined cutting feed adjusting mechanism is connected to rear-end symmetrical hinge holes of the milling mechanism, the other end of the inclined cutting feed adjusting mechanism is connected to front-end symmetrical hinge holes of the square extension beam, and a milling mechanism angle sensor is disposed in the inclined cutting feed adjusting mechanism to adjust the milling cutter head to reach an inclined cutting state.

10. An automatic cutting control method of the roadway/tunnel excavation robot according to claim 9, comprising following steps:

step 1: controlling, by the controller, the walking platform to enable the milling mechanism of the excavation robot to fit on a coal-rock mass excavation surface and a supporting and stabilizing mechanism to support on roof and floor or sidewall of a roadway, and opening an anti-skid mechanism and supporting on the floor of the roadway;

step 2: starting the drive unit, driving, by the drive unit, the eccentric rotary casing to rotate, and driving, through a rotation of the inner hole of the eccentric rotary casing, the milling shaft and the milling cutter head to rotationally swing together; when the drive unit is started, opening a low-pressure cooling water pipe, and cooling, by cooling water flowing through an outer wall of a connecting section of the milling shaft, a contact surface of the connecting section of the milling shaft and the inner hole of the eccentric rotary casing; and when the drive unit is started, starting a high-pressure water pipe jet unit, and impacting, by the high-pressure jet, a rotationally oscillated cutter head to form an oscillating jet for assisting the milling cutter head in breaking rocks;

step 3: controlling, by the controller, the inclined cutting feed adjusting mechanism to enable a dish-shaped hob to reach the inclined cutting state, controlling, by the controller, a lifting oil cylinder to enable the dish-shaped hob to move downwards, and controlling, by the controller, the telescopic oil cylinder to enable the square extension beam to extend out of a square shell, so that the dish-shaped hob achieves a downward and forward compound motion to be inclinedly cut into rock mass; indirectly detecting, by the tension and compression sensor, the force load of the connecting fastener between a milling shaft support seat and the milling mechanism housing, and when the detected load reaches a preset value, starting a high-pressure water system; detecting, by the direction sensor disposed on the milling mechanism housing, the movement direction of the dish-shaped hob, and opening, by a high-pressure water opening and closing device, a corresponding high-pressure jet nozzle disposed on the milling shaft support seat according to the detected movement direction of the dish-shaped hob, so that an oscillating jet is formed in the movement direction of the dish-shaped hob to assist in rock breaking; and disposing the displacement sensor on the telescopic oil cylinder to detect the displacement of the telescopic oil cylinder, controlling the telescopic oil cylinder to enable the dish-shaped hob to reach a predetermined milling thickness, and controlling the inclined cutting feed adjusting mechanism to enable the dish-shaped hob to approximately fit on the rock mass excavation surface to reach a milling state;

step 4: according to signals of a lifting angle sensor disposed at a hinged position at the tail end of the square shell and a rotary angle sensor at an outer circumferential position of the horizontal swinging mechanism, calculating, by the controller, a position of the dish-shaped hob on the rock mass excavation surface, and controlling the lifting oil cylinder and the horizontal swinging mechanism to enable the dish-shaped hob disposed on the milling mechanism to mill the coal-rock mass according to a preset milling path; and after the milling of the coal-rock mass excavation surface with a predetermined thickness is completed once, enabling the milling mechanism to return to an initial position in step 1;

step 5: continuously repeating step 3 and step 4 until the telescopic oil cylinder reaches a maximum stroke, and drawing back the supporting and stabilizing mechanism and the anti-skid mechanism to complete the milling of coal-rocks after the excavation robot is fixed once; and step 6: repeating steps 1 to 5 to achieve the automatic cutting of the coal-rock mass excavation surface.

* * * * *